US009011971B2

(12) United States Patent
Shiao

(10) Patent No.: US 9,011,971 B2
(45) Date of Patent: Apr. 21, 2015

(54) SHOE ORNAMENT STRUCTURE AND METHOD FOR MAKING THE SAME

(75) Inventor: Jui-Fen Shiao, Taichung (TW)

(73) Assignee: Dah Lih Puh Co., Ltd., Taichung (TW)

( * ) Notice: Subject to any disclaimer, the term of this patent is extended or adjusted under 35 U.S.C. 154(b) by 907 days.

(21) Appl. No.: 13/189,146

(22) Filed: Jul. 22, 2011

(65) Prior Publication Data

US 2013/0019506 A1 Jan. 24, 2013

(51) Int. Cl.

| | |
|---|---|
| ***A43B 23/24*** | (2006.01) |
| ***B05D 5/10*** | (2006.01) |
| ***A43B 1/00*** | (2006.01) |
| ***A43B 3/00*** | (2006.01) |

(52) U.S. Cl.

CPC ..... *A43B 23/24* (2013.01); *A43B 1/0072* (2013.01); *A43B 3/0078* (2013.01); *A43B 3/0084* (2013.01)

(58) Field of Classification Search

CPC ..... A43B 23/24; A43B 1/0072; A43B 3/0084

USPC ..... 427/207.1, 421.1; 36/136, 137

See application file for complete search history.

(56) References Cited

U.S. PATENT DOCUMENTS

| | | | | |
|---|---|---|---|---|
| 5,611,621 | A * | 3/1997 | Chien | 362/84 |
| 5,813,148 | A * | 9/1998 | Guerra | 36/137 |
| 2005/0223602 | A1* | 10/2005 | Cagliari | 36/136 |
| 2010/0003472 | A1* | 1/2010 | Lien | 428/195.1 |

* cited by examiner

*Primary Examiner* — Cachet Sellman

(74) *Attorney, Agent, or Firm* — Wang Law Firm, Inc.; Li K. Wang; Stephen Hsu

(57) ABSTRACT

A shoe ornament structure, comprises: a base layer, a sub-base layer, a ground color layer, a ornamental layer, a blocking wall and a transparent layer. The ground color layer has a predetermined thickness and is formed on the sub-base layer. The ornamental layer is formed with different grains or color or materials and located on the ground color layer. The blocking wall of a height 0.5-0.7 mm is formed on ornamental layer, and the transparent layer is formed in the area defined by the blocking wall.

9 Claims, 6 Drawing Sheets

SHOE ORNAMENT STRUCTURE AND METHOD FOR MAKING THE SAME

BACKGROUND OF THE INVENTION

1. Field of the Invention

The present invention relates to a shoe, and more particularly to a shoe ornament structure and a method for making the same.

2. Description of the Prior Art

Referring to FIG. 1, a conventional shoe ornament structure which is a plastic ornamental piece 11 is attached to the mesh upper 10 of a shoe by sewing thread 12. However, sewing the plastic ornamental piece 11 to the mesh upper 10 has the following disadvantages:

Firstly, the mesh upper and the plastic ornamental piece must be formed prior to sewing, especially, the plastic ornamental piece 11 has to be formed by injection molding, and it will even be subjected to several cycles of injection molding if the plastic ornamental piece 11 is made of different materials of different color. The forming of the plastic ornamental piece 11 is complicated. After that, the plastic ornamental piece 11 is then sewed to the mesh upper 10, and sewing operation is skillful and not easy.

Secondly, sewing will inevitably leave a clearance between the periphery of the plastic ornamental piece 11 and the mesh upper 10, where dust and dirty are likely to accumulate, making the shoe looks dirty, and the peripheral edge of the plastic ornamental piece 11 is likely to fold up around the clearance thereof.

The plastic ornamental piece 11 may also be attached to the mesh upper 10 by gluing, however, the problem is that glue may lose its adhesiveness over time.

The present invention has arisen to mitigate and/or obviate the afore-described disadvantages.

SUMMARY OF THE INVENTION

The primary object of the present invention is to provide a method for forming a shoe ornament on a mesh upper without sewing.

The method for forming a shoe ornament on a mesh upper in accordance with the present invention comprises the following steps:

forming a base layer: putting a screen printing device on a surface of the mesh upper for later screen printing process, wherein the mesh upper includes an upper and a lower gauze layers and a support mesh layer, the screen printing device applies glue material onto the mesh upper and fill in the spaces of the upper gauze layer and then dries to form a base layer on the upper gauze layer of the mesh upper;

forming a sub-base layer which is uncured on the base layer by performing screen printing before the base layer is fully cured, after that, a heating and pressing process is carried out to heat and press the sub-base layer and the base layer to make the sub-base layer and the base layer integrally cured together;

forming a blocking wall by applying screen printing to create a closed area in which a pattern or trademark formed on the surface of the ornamental layer is shown;

forming a transparent layer in the area defined by the blocking wall by dotting glue;

completing a final product: when the transparent layer dries and cures, the ornament is integrally formed on and bonded to the mesh upper without sewing.

The screen printing device comprises a frame and a mesh bottom at the bottom of the frame, a blocking layer is arranged on the mesh bottom and located outside the area where the ornament is to be formed to block the passage of printing material, so that the printing material will be printed on the mesh via non-blocking-layer area of the mesh bottom, on the mesh bottom is further provided a scraping plate or a printing roller with glue material on its surface.

The glue material is water based.

The heating and pressing is carried out by covering the sub-base layer with an ironing cover and then using an electric ironing device to heat and press the sub-base layer and the base layer.

A ground color layer of a predetermined thickness is formed on the sub-base layer by screen printing, and the ground color layer can be added with pigments.

An ornamental layer is formed on the ground color layer by applying screen printing, and the ornamental layer is formed with different grains or color or materials.

The blocking wall has a height ranging 0.5 to 0.7 mm.

The transparent layer is colored and takes the shape of a convex lens magnifying the pattern thereunder.

An ornament to be formed on a mesh upper of a shoe, the mesh upper including an upper and a lower gauze layers and a support mesh layer therebetween, the ornament comprising:

a base layer formed the upper gauze layer;

a sub-base layer formed on the surface of the base layer;

a ground color layer formed on the sub-base layer;

an ornamental layer formed on the ground color layer;

a blocking wall formed on ornamental layer; and a transparent layer formed in the area defined by the blocking wall.

A ground color layer of a predetermined thickness is formed on the sub-base layer by screen printing, and the ground color layer can be added with pigments.

The ornamental layer is formed with different grains or color or materials.

The blocking wall has a height ranging 0.5 to 0.7 mm.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
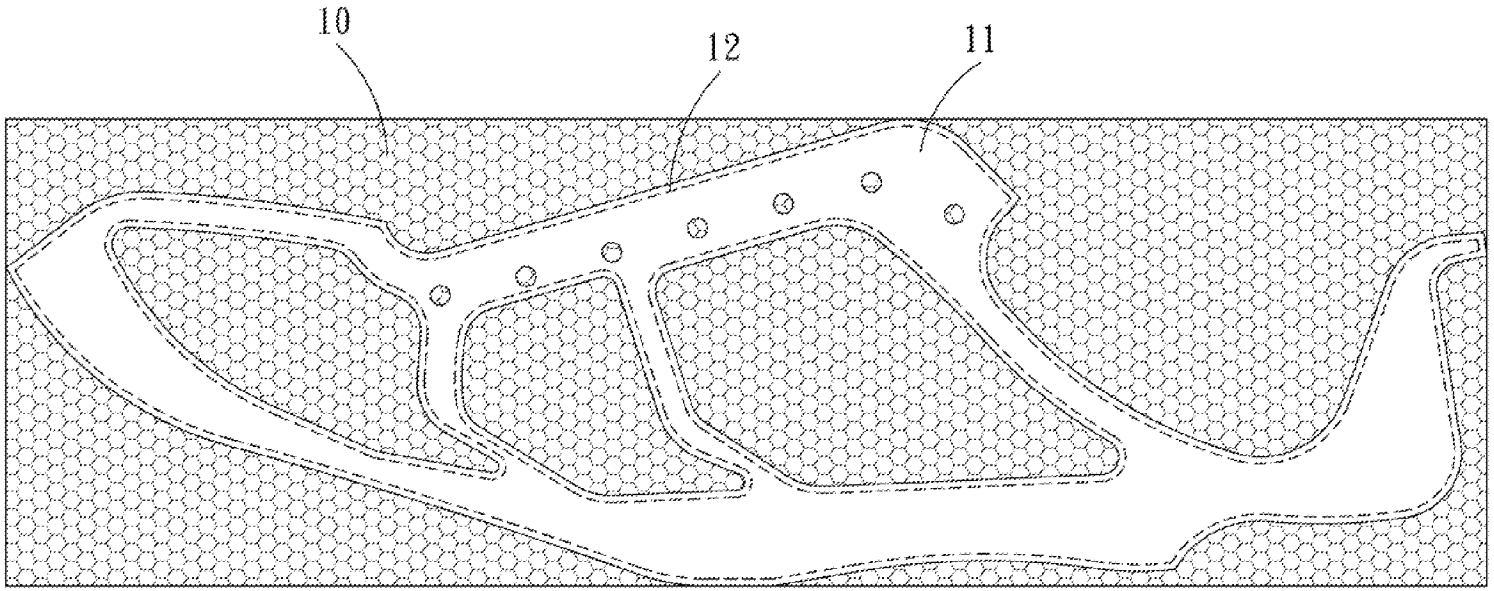
FIG. 1 PRIOR ART
FIG. 1 shows a conventional method for fixing an ornamental piece to the upper of a shoe.
Figure 2:
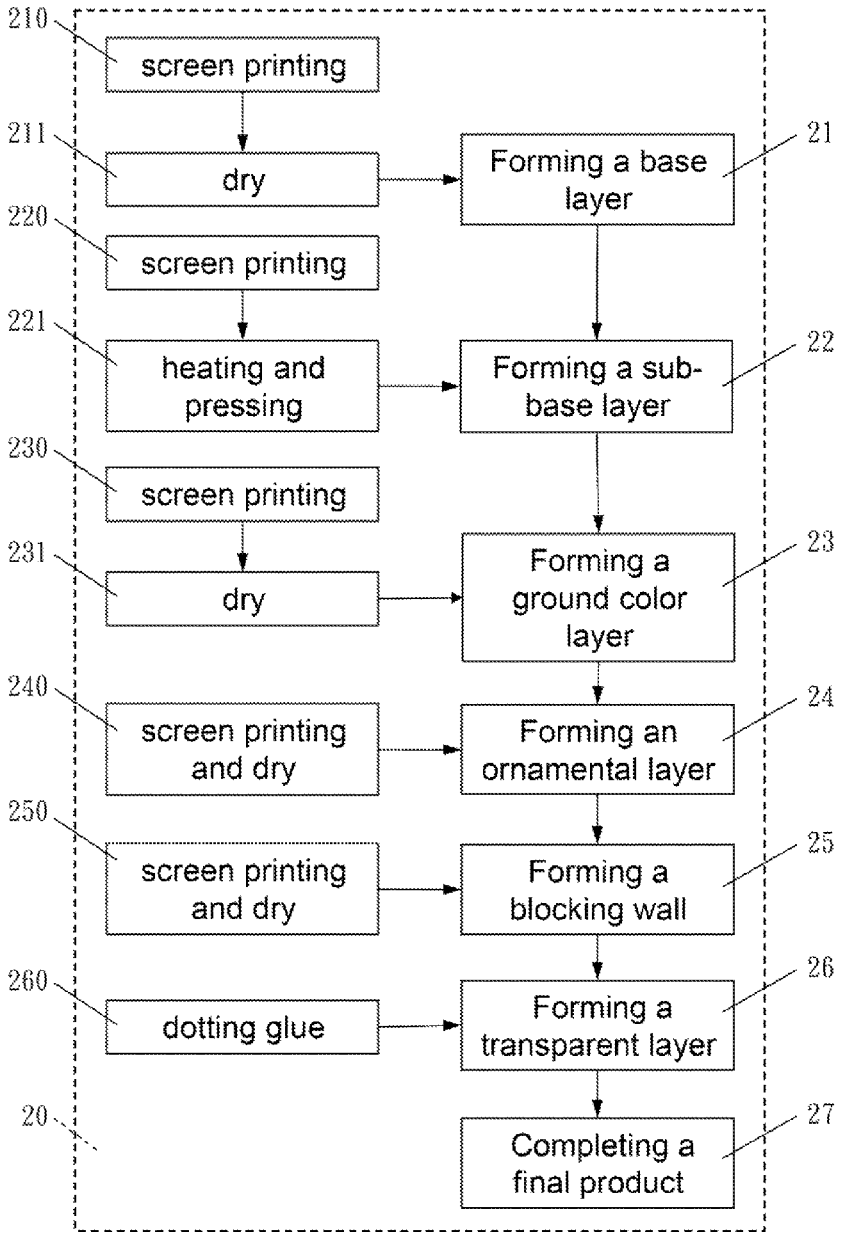
FIG. 2 is a flowchart in accordance with the present invention showing the steps of forming ornament on the upper.
Figure 3:
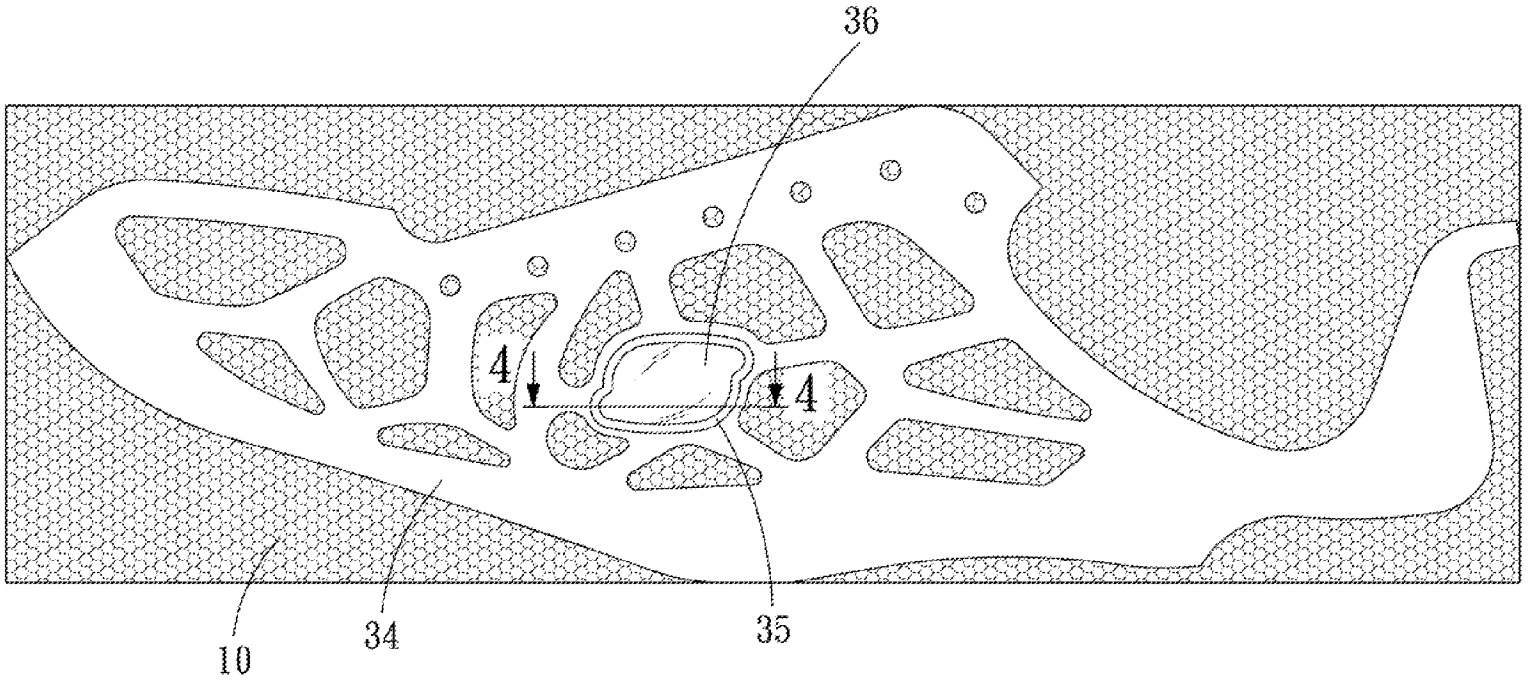
FIG. 3 shows an ornament formed on an upper of a show in accordance with the present invention.
Figure 4:
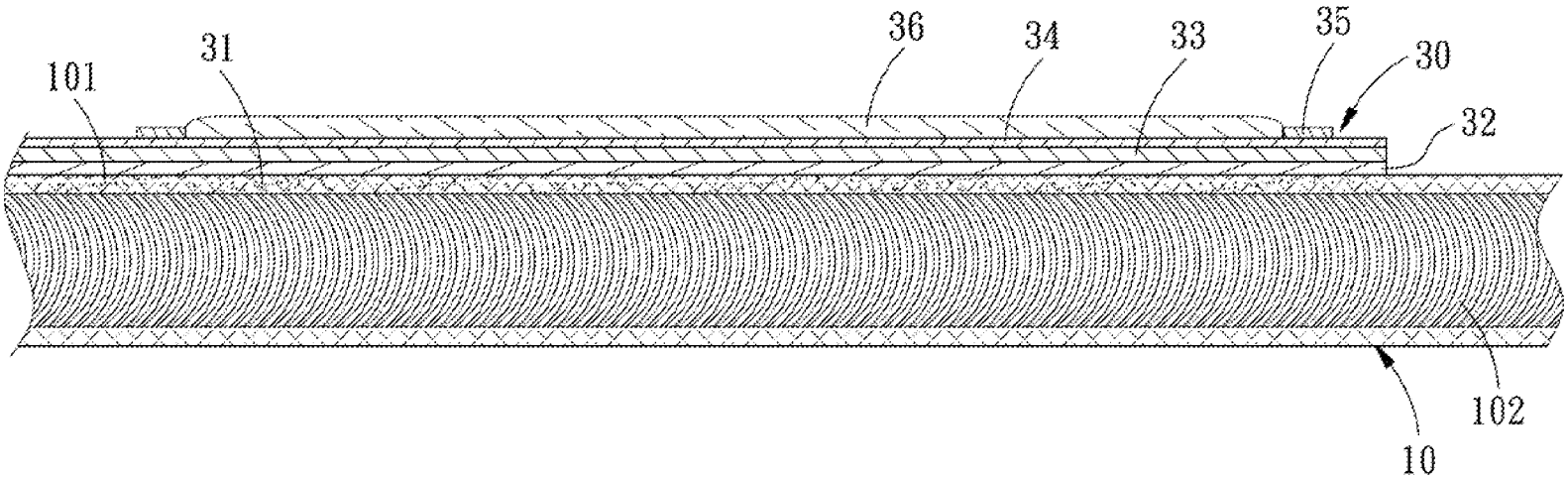
FIG. 4 is a cross sectional view of FIG. 3.

Referring to FIGS. 2-4, a method 20 for forming a shoe ornament 30 on a mesh upper 10 is shown and comprises the following steps (as particularly shown in FIGS. 2 and 5):

Forming a base layer 31 (step 21): putting a screen printing device 40 on the surface of the mesh upper 10 of shoe for later screen printing process, wherein the mesh upper 10 includes an upper and a lower gauze layers 101 and a support mesh layer 102 therebetween.

The screen printing device 40 comprises a frame 41 and a mesh bottom 42 at the bottom of the frame 41. A blocking layer 420 is arranged on the mesh bottom 42 and located outside the area where the ornament 30 is to be formed to block the passage of printing material, so that the printing material will be printed on the mesh upper 10 via non-blocking-layer area of the mesh bottom 42. On the mesh bottom 42 is further provided a scraping plate (not shown) or a printing roller 43 with glue material on its surface. After 1-3 times of screen printing (step 210) by rolling the printing roller 43, the glue material is pressed through the mesh bottom 42 onto the mesh upper 10 and fill in the spaces of the upper gauze layer 101 and then dries (step 211) to form a base layer 31 of a predetermined thickness on the upper gauze layer 101 of the mesh upper 10. The glue material is water based.

Forming a sub-base layer 32 (step 22): before the base layer 31 is fully cured, screen printing (step 220) is carried out for one time again by using the same glue material as mentioned above to form a sub-base layer 32 which is uncured on the base layer 31. After that, a heating and pressing (step 221) is carried out by covering the sub-base layer 32 with an ironing cover 51 with release agent and then using an ironing device 50 (such as an electric ironing device) to heat and press the sub-base layer 32 and the base layer 31, so that the sub-base layer 32 and the base layer 31 are integrally cured together, and the sub-base layer 32 is densified and become more flat.

Forming a ground color layer 33 (step 23): a certain number of times of screen printing (step 230) is performed to form a ground color layer 33 of a predetermined thickness on the whole area or a part of the sub-base layer 32, and then the ground color layer 33 dries (step 231), the ground color layer 33 can be added with pigments.

Forming an ornamental layer 34 (step 24) of a predetermined thickness on the whole area or a part of the sub-base layer 32 or the ground color layer 33 by applying screen printing (step 240), the screen printing (step 240) can be performed for one or more times to form the ornamental layer 34 with a desired thickness, and the ornamental layer 34 can be formed by adding different colored materials into the same glue material mentioned above or the blocking layer 420 is formed with different grains or glue materials, such as silicon, PVC, etc, so as to provide a different tactile or visual features, such as trademark or special patterns.

Forming a blocking wall 35 (step 25) of a height approximately 0.5-0.7 mm on the whole or a part of or a designed part of the sub-base layer 32 or the ground color layer 33 or the ornamental layer 34 by applying screen printing (step 250) for 3-7 times to create a closed area in which a pattern or trademark formed on the surface of the ornamental layer 34 is shown. The surface of the sub-base layer 32 or the ground color layer 33 or the ornamental layer 34 enclosed by the blocking wall 35 can circle around the trademark or special patterns.

Forming a transparent layer 36 (step 26) in the area defined by the blocking wall 35 by dotting glue (step 260), the transparent layer 36 can be colored and takes the shape of a convex lens magnifying the pattern thereunder, and the transparent layer 36 can be made of glue material, such as PVC, PE or PC.

Figure 5:
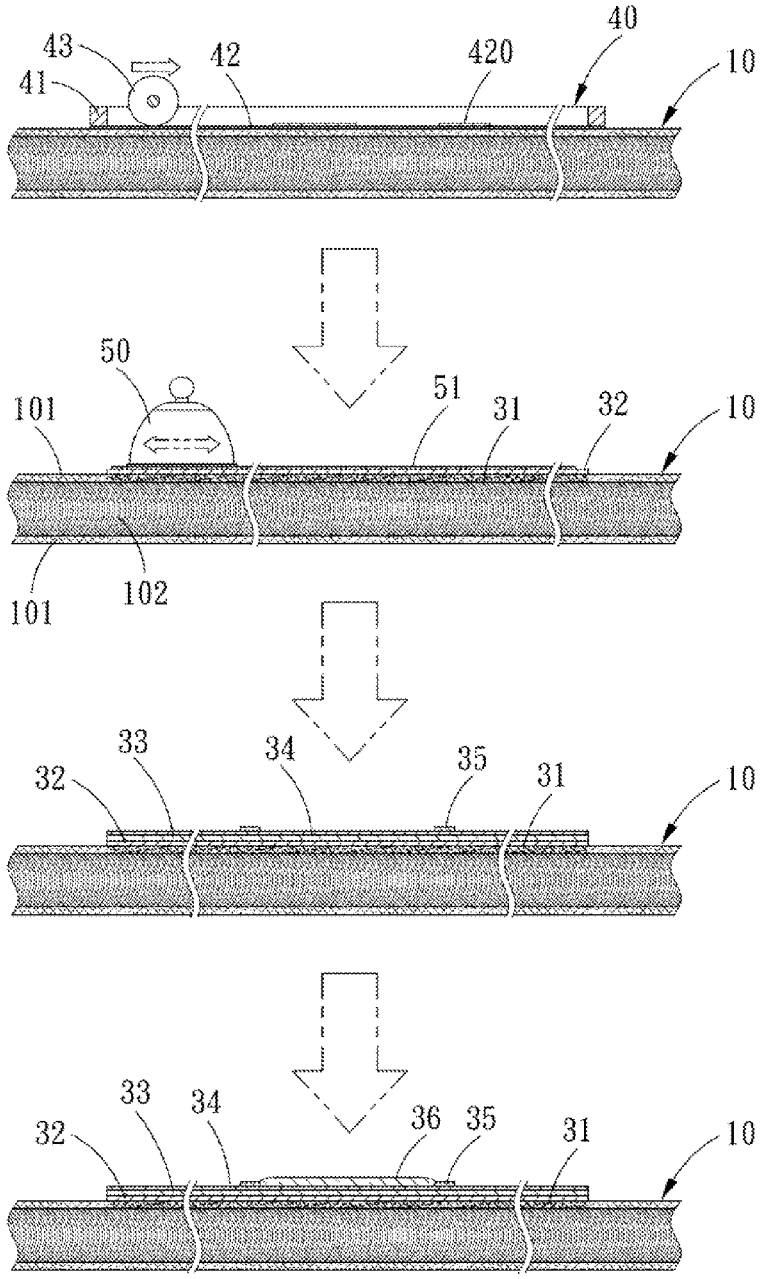
FIG. 5 is an illustrative view showing the steps of forming an ornament on an upper of a show in accordance with the present invention.

Completing a final product (step 27): when the transparent layer 36 dries and cures, the ornament 30 will be integrally formed on and bonded to the mesh upper 10 without sewing, as shown in FIG. 5.

The ornament 30 of the shoe; as shown in FIGS. 3 and 4, comprises: the base layer 31, the sub-base layer 32, a ground color layer 33, an ornamental layer 34, a blocking wall 35 and a transparent layer 36.

The base layer 31 melts on the upper gauze layer 101 and then is formed integral with the upper gauze layer 101 after it dries.

The sub-base layer 32 is located on the surface of the base layer 31 and has a density larger than that of the base layer 31.

The ground color layer 33 has a predetermined thickness and is formed on the sub-base layer 32 by multiple times of screen printing.

The ornamental layer 34 is formed with different grains or color or materials and located on the ground color layer 33.

The blocking wall 35 of a height 0.5-0.7 mm is formed on a specified area of the sub-base layer 32 or the ground color layer 33 or the ornamental layer 34.

And then the transparent layer 36 is formed in the area defined by the blocking wall 35 by dotting glue, and the pattern or trade mark can be seen through the transparent layer.

Referring then to FIGS. 3 and 4, the ornament 30 of the shoe comprises the base layer 31 formed integral with the upper gauze layer 101 on the upper gauze layer 101 and the sub-base layer 32 on the surface of the base layer 31. The ground color layer 33 has a predetermined thickness and is formed on the sub-base layer 32. On the surface of the ground color layer 33 is selectively formed with the ornamental layer 34 when needed. The blocking wall 35 of a height 0.5-0.7 mm is formed on a specified area of the ornamental layer 34. The transparent layer 36 is formed in the area defined by the blocking wall 35 by dotting glue.

Figure 6:
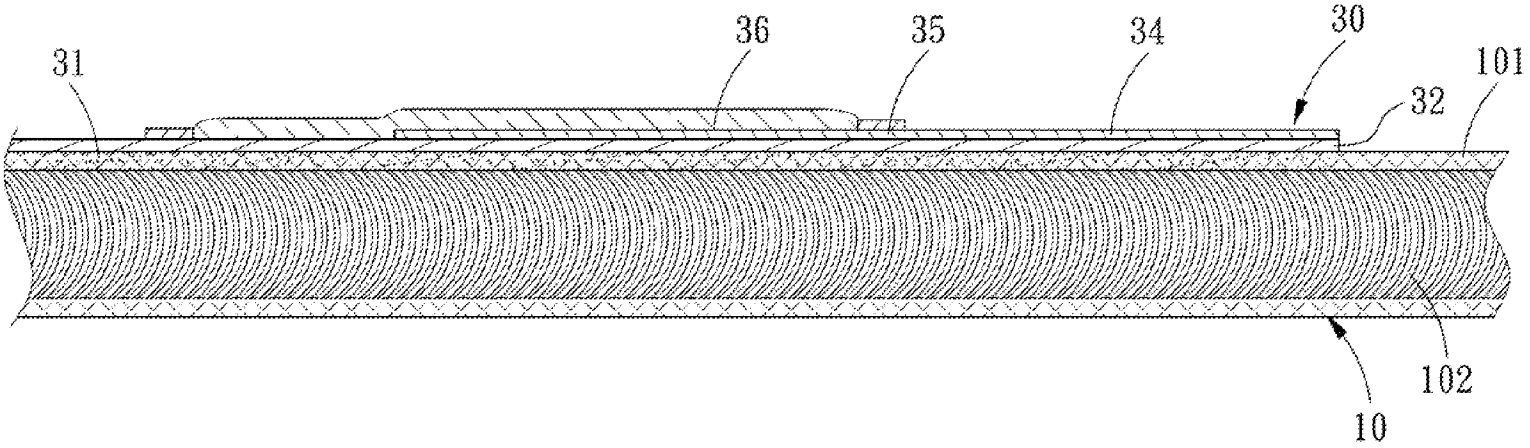
FIG. 6 shows an ornament of a show in accordance with another embodiment of the present invention.

Referring finally to FIG. 6, the ornament 30 of the shoe comprises the base layer 31 formed integral with the upper gauze layer 101 on the upper gauze layer 101 and the sub-base layer 32 on the surface of the base layer 31. The ornamental layer 34 is directly formed on the surface of the ground color layer 33. The blocking wall 35 of a height 0.5-0.7 mm is formed on a specified area of the ornamental layer 34 and extends to the no-ornamental-layer area of the surface of the sub-base layer 32. The transparent layer 36 is formed in the area defined by the blocking wall 35 by dotting glue. This method doesn't require the forming of a ground color layer 33 (step 23).

While we have shown and described various embodiments in accordance with the present invention, it is clear to those skilled in the art that further embodiments may be made without departing from the scope of the present invention.

What is claimed is:

1. A method for forming a shoe ornament on a mesh upper comprising the following steps:

forming a base layer by putting a screen printing device on a surface of the mesh upper, wherein the mesh upper includes an upper and a lower gauze layer and a support mesh layer, applying glue material using the screen printing device onto the mesh upper and fill in spaces of the upper gauze layer and then dries to form a base layer on the upper gauze layer of the mesh upper;

forming an uncured sub-base layer which is on the base layer by performing screen printing before the base layer is fully cured, then carrying out a heating and pressing process is carried out to heat and press the sub-base layer and the base layer to make the sub-base layer and the base layer integrally cured together;

forming a blocking wall by applying screen printing to create a closed area in which a pattern or trademark formed on a surface of an ornamental layer is shown;

forming a transparent layer in the closed area defined by the blocking wall by dotting glue, to display a pattern enclosed by the blocking wall;

when wherein after the transparent layer dries and cures, the ornament is integrally formed on and bonded to the mesh upper without sewing.

2. The method for forming a shoe ornament on a mesh upper as claimed in claim 1, wherein the screen printing device comprises a frame and a mesh bottom at the bottom of the frame, a blocking layer is arranged on the mesh bottom and located outside the area where the ornament is to be formed to block the passage of printing material, so that the printing material will be printed on the mesh via non-blocking-layer area of the mesh bottom, on the mesh bottom is further provided a scraping plate or a printing roller with glue material on its surface.

3. The method for forming a shoe ornament on a mesh upper as claimed in claim 1, wherein the glue material is water based.

4. The method for forming a shoe ornament on a mesh upper as claimed in claim 1, wherein the base layer is formed by performing screen printing one to three times.

5. The method for forming a shoe ornament on a mesh upper as claimed in claim 1, wherein the heating and pressing is carried out by covering the sub-base layer with an ironing cover and then using an electric ironing device to heat and press the sub-base layer and the base layer, the ironing cover is provided with a release agent.

6. The method for forming a shoe ornament on a mesh upper as claimed in claim 1, wherein a ground color layer of a predetermined thickness is formed on the sub-base layer by screen printing, and the ground color layer can be added with pigments.

7. The method for forming a shoe ornament on a mesh upper as claimed in claim 6, wherein an ornamental layer is formed on a whole or a part of the ground color layer or the sub-base layer by applying screen printing one or several times, and the ornamental layer can be formed by adding different colored materials into the glue material or a blocking layer is formed with different grains or glue materials, so as to provide a different tactile or visual features.

8. The method for forming a shoe ornament on a mesh upper as claimed in claim 7, wherein the blocking wall has a height ranging 0.5 to 0.7 mm and is formed on the whole or a part of or a designed part of the sub-base layer or the ground color layer or the ornamental layer by applying screen printing 3-7 times to create a closed area in which a pattern or trademark formed on the surface of the ornamental layer is shown.

9. The method for forming a shoe ornament on a mesh upper as claimed in claim 1, wherein the transparent layer is colored and takes the shape of a convex lens magnifying the pattern thereunder.

* * * * *